United States Patent [19]

Madison

[11] 3,938,718

[45] Feb. 17, 1976

[54] BACKPACK FRAME AND ASSEMBLY

[75] Inventor: George Benjamin Madison, Wichita, Kans.

[73] Assignee: The Coleman Company, Inc., Wichita, Kans.

[22] Filed: Apr. 11, 1974

[21] Appl. No.: 459,876

[52] U.S. Cl. ..... 224/25 A; 24/265 AL

[51] Int. Cl.[2] ..... A45F 3/00

[58] Field of Search..... 224/5 R, 5 A, 8 R, 9, 10, 224/25 R, 25 A; 24/114.5, 265 R, 265 AL

[56] References Cited

UNITED STATES PATENTS

| | | | |
|---|---|---|---|
| 797,667 | 8/1905 | Davis | 224/8 R |
| 2,421,244 | 5/1947 | Daiber | 224/25 A |
| 2,611,519 | 9/1952 | Utterström | 224/25 A |
| 3,033,431 | 5/1962 | Henderson et al. | 224/5 W |
| 3,114,486 | 12/1963 | Flexman | 224/8 R |
| 3,191,828 | 6/1965 | Senne | 224/25 A |
| 3,233,803 | 2/1966 | Gray | 224/8 R |
| 3,733,017 | 5/1973 | Pletz | 224/25 A |
| 3,774,825 | 11/1973 | Schone et al. | 224/25 A |

FOREIGN PATENTS OR APPLICATIONS

| | | | |
|---|---|---|---|
| 90,308 | 9/1957 | Norway | 224/8 R |

*Primary Examiner*—Robert G. Sheridan
*Assistant Examiner*—Lawrence J. Oresky
*Attorney, Agent, or Firm*—Dawson, Tilton, Fallon & Lungmus

[57] ABSTRACT

A backpack permits the wearer to adjust the shoulder straps, backband, and waistband to his individual needs or desires. An integral molded plastic frame is specially contoured to avoid restrictions of motion on the person wearing it. The frame is provided with a number of slots which permit attachment of the sack and adjustment of the locations at which the shoulder straps, backband and waistband or belt are attached. The shoulder straps include loops of material which fit through the slot and are held in the desired position by a specially designed removable fastener. The waistband may also be sized to the individual wearer's requirements by selectively adding or removing one of a plurality of pads which are threaded onto the belt for comfort.

14 Claims, 14 Drawing Figures

BACKPACK FRAME AND ASSEMBLY

BACKGROUND AND SUMMARY

The present invention relates to backpacks of the type used by hikers or campers. Most commercial backpacks are made from metal frame members which are connected together, usually with special connectors and employing a lightweight metal tube as the basic frame element. Once the frame is assembled, shoulder straps, backband, if any, and waistband are secured to or wrapped around the frame, and then fastened to a wearer. A number of ties are usually provided for attaching the sack carried by the frame. A camper's utensils, provisions and the like are, of course, carried in the sack. Additional items may be tied onto the frame, if desired.

Normally, each manufacturer makes a frame in a single size and it is therefore sometimes difficult to arrange the fittings and utensils to make the backpack comfortable for bearers of different height, weight, and size. Equally important, however, is the need to accommodate the backpack to the particular use for which it is intended. That is to say, backpacks are put to such widespread use that it is highly desirable to enable great flexibility in attaching the various things that are carried on the backpack to the frame. This enables the bearer to distribute the load as he desires and to minimize obstruction with normal walking motions.

I have also found that an important aspect of providing a backpack system is that each individual bearer has his own likes and dislikes regarding weight distribution, comfort, restriction on motions, and so on. In other words, the usual backpack bearer is a highly individualistic person who, after gaining some experience, likes to "design" his own backpack arrangement, including placement of the shoulder straps, backband and waistband, and tying the various loads to the frame. The present invention is intended for use by just such an individual since it can be modified to suit almost any need or desire, as will become clear from a fuller understanding of the invention.

Briefly, the present invention includes an integrally molded, specially contoured plastic frame which provides a recess for the head and includes a peripheral frame portion which is contoured inwardly adjacent the arms to avoid restriction of arm motion during walking. The side frame members thence flare outwardly at about the elbow location toward the waist, and the lower portion of the frame is contoured rearwardly so as to avoid bumping against the buttocks of a bearer. We have found that by making the frame of molded plastic, the desired contours can be achieved while producing a backpack frame which is economical enough to be competitive. Further, a plurality of slots are provided in the peripheral portion of the frame so that the backband may be adjustably mounted to it and to provide additional tie locations for the pack that is secured to the frame. Such thoughts on the lower peripheral portion further provide adjustment for the waistband, both as to its relative height on the frame and for waists of different thickness. The frame also includes a backplate which is provided with a plurality of slots arranged at different heights relative to the frame and at different lateral spacings so as to adjust the rear attachment of the shoulder straps thereto—again, giving the bearer complete freedom to design the back assembly according to its needs or desires.

The shoulder straps are attached to the frame by means of loops at either end. Such loops are of a width narrower than the associated slots on the frame so that they may be slipped through a particular slot doubled over to provide a looped portion extending through the slot. A fastener including a cylindrical member is then attached to the loop of material and prevents the loop from being drawn back through the slot. The fastener also includes a flexible guard member which may be hinged relative to the cylindrical member to facilitate placing the cylindrical member into engagement with a loop for fastening. The guard member, when released after the cylindrical portion is placed in a loop, then couples over the loop and acts as a buckle to hold the fastener to the strap.

The preferred waistband or belt includes three removable separate padded sections, each including a runway through which a belt may be fitted. For smaller waists, one of the sections is removed. The belt is provided with a pair of loops which fit through slits in the pads and through corresponding slots in the frame. Fasteners are then used to secure the belt loops and waist pads to the frame. For bigger waists, the third padded section is inserted between the two just mentioned, and they are moved sideways on the belt, the loops on the belt then registering with a second set of slots in the padded sections and a second set of slots on the frame so that the fasteners may then be used to hold the two side padded sections at a wider spacing on the belt.

Other features and advantages of the present invention will be apparent to persons skilled in the art from the following detailed description of a preferred embodiment wherein identical reference numerals will refer to like parts in their various views.

THE DRAWING

DETAILED DESCRIPTION

Figure 1:
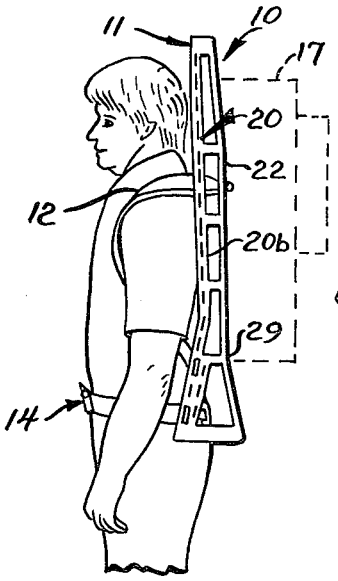
FIG. 1 is a side view of a backpack frame and assembly according to the present invention as it would be worn by a bearer.

Referring first to FIG. 1, reference numeral 10 generally designaates a backpack frame and assembly, and as shown, it is secured for use on a person, sometimes referred to as a "bearer". The assembly 10 includes a frame generally designated 11, a pair of shoulder straps 12 and 13 (see FIG. 2), a waistband assembly generally designated 14, and a backband generally designated 15 in FIG. 2. A sack, illustrated by the dashed line 17 may be secured to the backpack frame 11, but it may be of conventional design. The frame is preferably made of rigid plastic foam, such as polypropylene foam.

Figure 2:
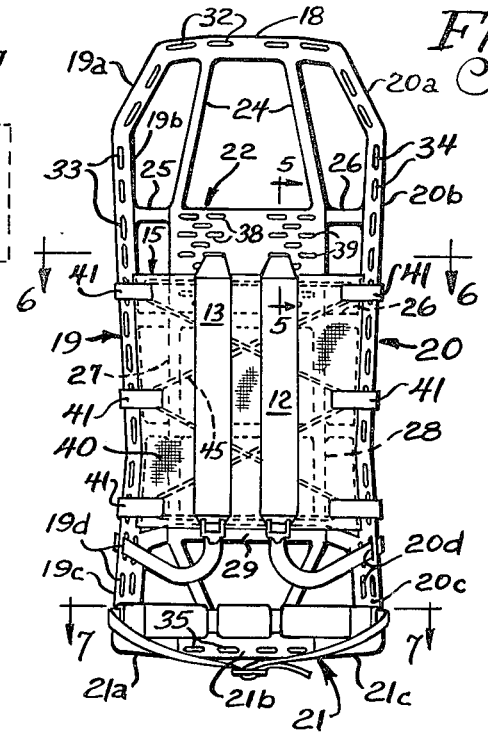
FIG. 2 is a front elevation view of the backpack frame and assembly of FIG. 1.
Figure 2A:
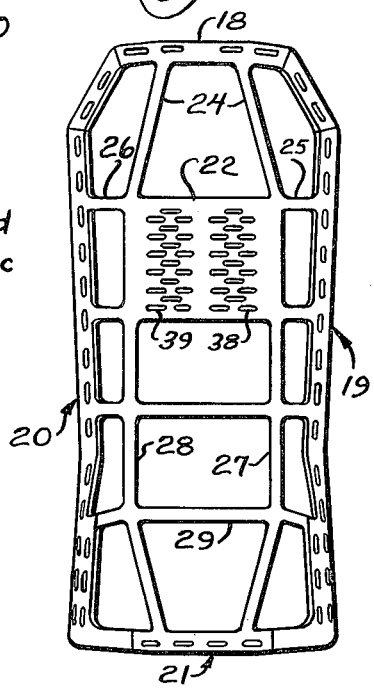
FIG. 2A is a rear view of the frame.

Turning now to FIGs. 2 and 2A, the frame 10 is an integral, molded plastic frame. The frame 11 includes generally a top frame member 18, a first side frame member 19, a second side frame member 20, a bottom frame member 21, and a backplate portion 22. The top frame member 18, side frame members 19 and 20, and bottom frame member 21 form the periphery of the frame.

The side frame member 19 includes an upper portion 19*a* which is inclined outwardly of the top frame member 18, an elongated intermediate portion 19*b* which is inclined slightly inwardly from a position generally opposite the middle of the head of an average wearer down to his waist, and a lower portion 19*c* which is inclined slightly outwardly from the waist area to the hip area of a bearer which is where the bottom frame member 21 is located. Similarly, the peripheral side frame member 20 includes an upper portion 20*a*, an intermediate portion 20*b*, and a lower portion 20*c*.

The backplate 22 is formed integrally with a pair of upper frame members 24 extending to the top frame member 18. The backplate 22 is spaced rearwardly of the intermediate portions 19*b* and 20*b*, as best seen in FIG. 1; and it is connected to each of these intermediate portions by a pair of laterally extending strut members designated respectively 25 and 26. A pair of vertical rear frame members 27 and 28 are extended downwardly from the sides of the backplate 22 to a horizontal frame member 29 located approximately at a position just below the waist of the bearer illustrated in FIG. 1.

The lower frame member 21 includes a rear central portion 21*b* connected to the sides of the frame by rearwardly inclined horizontal members 21*a* and 21*c* respectively. Additional frame members are provided, as illustrated, to form a frame gridwork interconnecting the backplate 22, the peripheral side frames 19 and 20, and the horizontal frame member 29 for rigidity and strength.

Returning to FIG. 1, it will be observed that when the frame 11 is mounted to the back of a bearer, the intermediate portions 19*b* and 20*b* of the peripheral side frame members are located just inwardly of the shoulders, extending downwardly and slightly inwardly behind the elbow to permit unrestricted motion of the arms. This inward inclination ends just above the waist, so the narrowest portion of the peripheral frame occurs approximately behind the elbows—the most troublesome constriction for some prior frame constructions. From this location just above the waist, the peripheral side frame members extend downwardly and outwardly (19*c* and 20*c*) to provide for the hips; and the bottom frame member 21 is formed rearwardly so as to provide adequate space for the buttocks. Thus, the frame is adapted to be rigidly secured to the bearer's back while providing adequate arm room, head room and waist and buttocks room.

Referring again to FIG. 2, the upper frame member 18 is provided with a plurality of laterally extending, laterally spaced slots 32 which may be used for tying a sack to the frame or for fastening other utensils or equipment to be carried. Further, each of the peripheral side frame members 19, 20 are provided with a plurality of slots designated respectively 33 and 34 which extend in a general upright direction and are located at spaced intervals along the entire length of these peripheral side frame members. Further, the lower portions of the bottom side frame members 19*c* and 20*c* are seen to be relatively wider than the upper frame portions; and each is provided with a duplicate set of such slots, 19*d* and 20*d*. One set of slots is located inwardly of the other. Each set includes a number of vertically elongated slots which are spaced apart in the direction of elongation to permit upward and downward as well as inward and outward adjustment of the waistband. The rearmost portion 21*b* of the bottom frame member 21 is also provided with a plurality of slots, designated 35.

Six columns of horizontally elongated slots are arranged on the backplate 22. These are divided into a left side (as viewed from the front) set of three columns designated 38 and a right side set 39. Each side set of slots is arranged such that the slots at the left and right columns are aligned horizontally; and the slots in the center column are located at intermediate locations relative to these former columns of slots, as illustrated in FIGS. 2 and 2A. The purpose of this arrangement of slots is to permit a wide latitude in the adjustment of the location of the shoulder straps, both vertically and laterally, as will be made clear presently.

Figure 6:
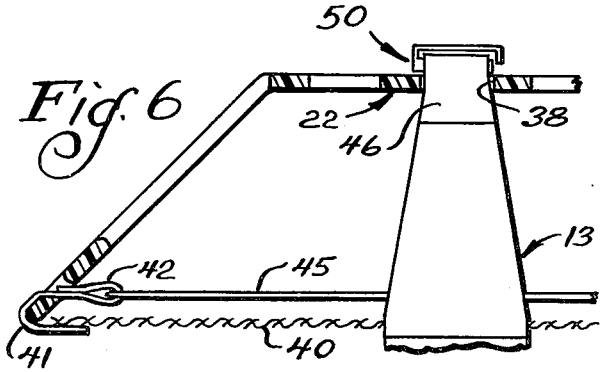
FIG. 6 is a fragmentary vertical cross sectional view taken through the sight line 6—6 of FIG. 2.

Referring now to FIGs. 2, 2A and 6, the backband 15 includes a net-like mesh 40 with three appendages or tabs 41 secured to each side—one at the top, one at an intermediate location, and one near the bottom. The tabs 41 extend laterally of the mesh 40, and they are provided at their distal ends with loops, one of which is designated 42 in FIG. 6. The backband is secured to the frame by passing the tabs 41 around the outside of the frame and in through an associated one of the slots 33, 34 along the peripheral side portions of the frame. A lace or tong 45 is then placed through the loops 42 in the manner illustrated in FIG. 2 and tied at the bottom after suitably tensioning the mesh 40 by drawing the tong. The backband holds the rigid plastic from direct contact with the bearer's body.

Figure 3:
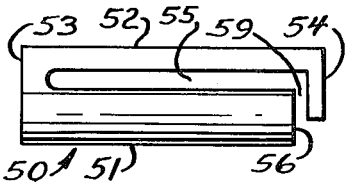
FIGS. 3 and 4 are respectively side and end views of a special fastener used in the assembly.
Figure 4:
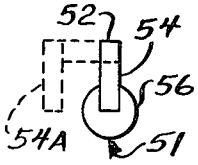

Turning now to the shoulder straps 12, 13, they are of similar construction, so that only one need be described for a full understanding of the invention. Referring to the shoulder strap 13, it includes a shoulder-engaging, padded section 45, the upper end of which is provided with a loop 46 (FIG. 6). The loop 46 is placed through one of the loops 38 on the backplate 22 and held there by means of a fastener generally designated by reference numeral 50. The fastener 50 is seen in better detail in FIGS. 3 and 4; and it includes a cylindrical member 51 and a locking arm 52. The locking arm 52 is attached to one end of the cylindrical member 51 by means of a hinging section 53 which permits the arm 52 to swing laterally of the cylinder 51 inwardly and outwardly of the plane of the page of FIG. 3—that is, upwardly and downwardly as seen in FIG. 4. The distal end of the arm 52 includes a finger 54 which extends in a generally radial direction of the cylinder 51 when the arm 52 is in its normal position (the normal position being generally parallel to the axis of the cylinder 51 and spaced from it as indicated at 55). It will be observed from FIG. 4 that the finger 54 extends inwardly in the normal position approximately to the axis of the cylinder 51. The finger 54 may be moved to an unlocking position as shown in dashed line at 54A in FIG. 4, in which case it will be seen that there is unrestricted axis to the space 55 and to the cylinder 51. The resiliency of the material (the fastener preferably being made of an elastomeric material) causes the arm 52 to swing back into the locking position shown in solid line in FIG. 4 wherein the finger 54 extends beneath the lower surface 56 of the cylinder 51—again, being spaced from it slightly as indicated at 59 in FIG. 3.

Figure 5:
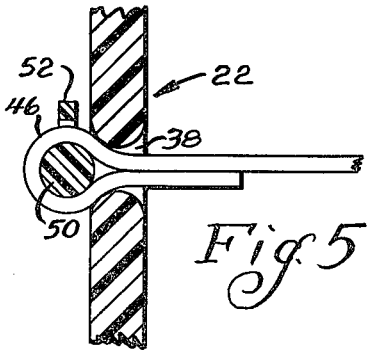
FIG. 5 is a fragmentary close-up view illustrating the use of the fastener shown in FIGS. 3 and 4 taken through the sight line 5—5 of FIG. 2.
Figure 8:
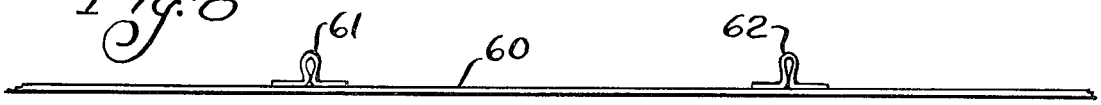
FIG. 8 is a fragmentary plan view of a waistband without padding sections.
Figure 9:
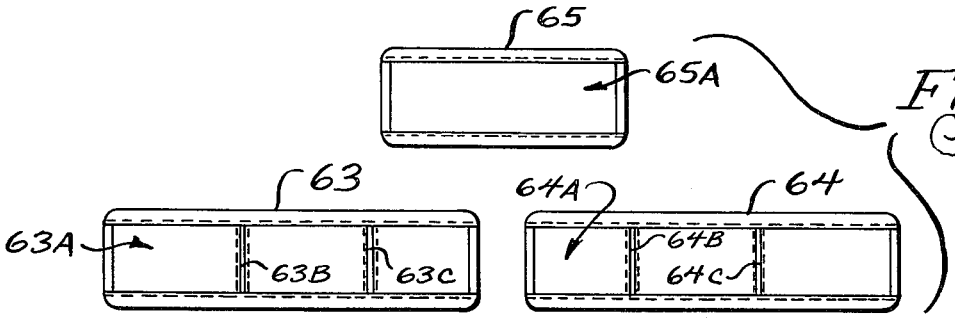
FIG. 9 is a rear view illustrating the three waist padding sections that may be used with the invention.

To secure the shoulder strap 13 to the backplate 22, the loop 46 is passed through one of the slots 38; and the arm 52 of the fastener 50 is pivoted to the unlocking position of FIG. 4. The cylinder 51 is then placed into that portion of the loop 46 which is passed through the slot 38 on the opposite side of the backplate 52 as seen in FIG. 6. When the arm 52 is released, it swings back into locking position; and the fastener is assembled to the loop 46 in locking relation. The loop 46 cannot be withdrawn back through the slot 38 because the diameter of the cylindrical member 51 is greater than the height of the slot (see FIG. 5).

The waistband 14, as seen in FIGS. 8–13 includes a belt 60 provided with two rearwardly extending loops 61 and 62. The belt includes a buckle, seen in FIG. 2. It also includes three separate padded elements, seen in FIG. 9 including first and second side padded elements 63 and 64 and a center padded element 65. Each of these elements is provided at its rear portion with a web, designated respectively 63A, 64A and 65A which is sewn at top and bottom to its associated pad. The webs provide an elongated loop through which the belt 60 is threaded. Each of the webs 63A and 64A are provided with vertically elongated slots, designated respectively 63B and 63C for the pad 63 and 64B and 64C for the pad 64.

Figure 10:
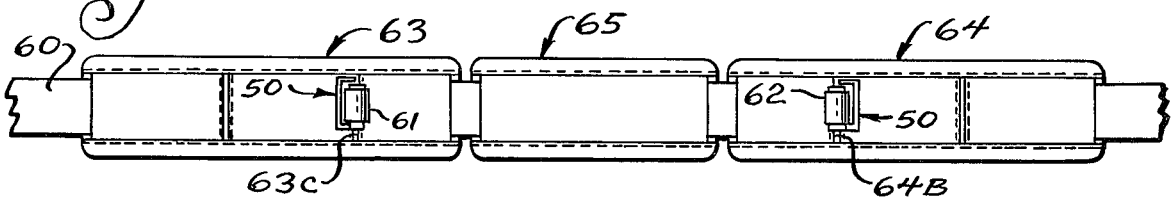
FIGS. 10 and 11 are fragmentary rear views of the waistband assembly for accommodating respectively larger and smaller waists.
Figure 13:
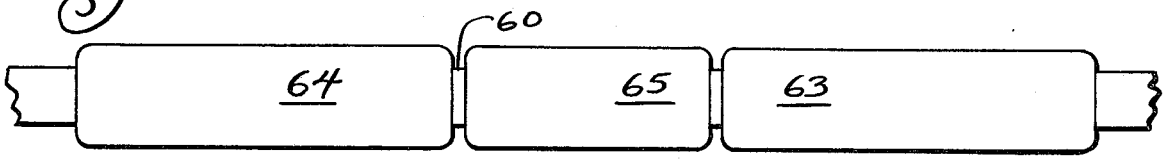
FIG. 13 is a front view of the waistband as seen in FIG. 10.

Referring now to FIGS. 10 and 13, when all three pads are used to accommodate a larger waist, the unslotted pad 65 is placed in the middle. It will be observed that it is somewhat shorter than the side pads. The loops 61, 62 on the belt 60 are placed through the innermost slots 63C, 64B respectively on the pads 63, 64. Fasteners 50 identical to the ones already described are then coupled to the loops to hold the belt pads in place.

Figure 11:
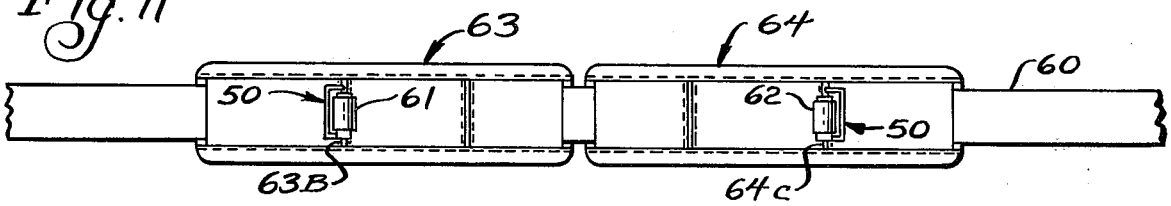
Figure 12:
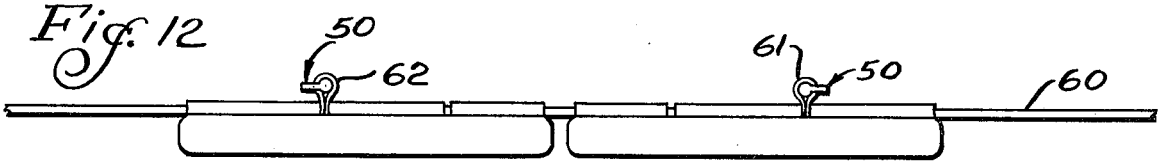
FIG. 12 is a bottom view of the waistband as seen in FIG. 11.

Referring now to FIGS. 11 and 12, to accommodate the waistband to a shorter waist, only the two side pads 63, 64 are used. In this case, the loops 61, 62 are placed through the outer slot 63B, 64C, on the pads 63, 64 respectively and then fastened by the fasteners 50, as illustrated.

Figure 7:
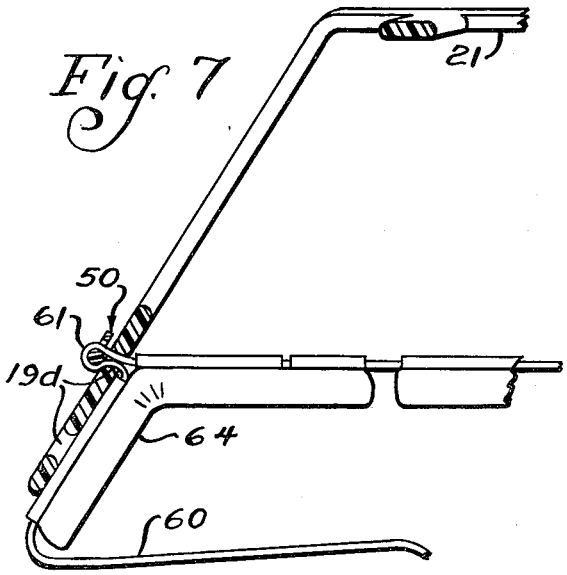
FIG. 7 is a fragmentary view taken through the sight line 7—7 of FIG. 2.

The waistband is attached to the backpack frame, as seen in FIGS. 2 and 7 by passing the loops 61, 62 through selected ones of the slots 19d, 20d and securing with a fastener 50. Each set of slots 19d, 20d includes an inner and an outer set of three vertically spaced slots for permitting the waistband to be adjusted upwardly from the position shown in FIG. 2, if desired or permitting attachment to an inner set.

Having thus described in detail the preferred embodiment of the invention, it will be appreciated that the assembly is uniquely suited for the many adjustments that may be required or desired to accommodate the physique of a particular bearer. At the same time, the adjustability permits the bearer to secure the various elements to his own liking—that is, he may design his own backpack assembly from these elements due to the highly adjustable features that are incorporated in it. In particular, the upper portions of the shoulder straps may be adjusted upwardly or downwardly or inwardly or outwardly in the slots, 38, 39 of the backplate 22. The use of the fasteners 50 greatly facilitates such adjustment. Further, the lower portions of the shoulder straps 12, 13 may be secured to the frame in any one of a number of different locations on the slotted peripheral frame members 19, 20. The backband 15 likewise may be adjusted upwardly or downwardly, and it may be adjusted in tension, if desired. Still further, the waistband assembly may be adjusted for waists of different size as well as adjusted upwardly or downwardly, inwardly or outwardly depending upon the height of the bearer and his preferred mounting. The unused slots on the peripheral frame portion provide additional tie locations for various items that may be desired to be carried.

It will, therefore, be appreciated that certain portions of the structure illustrated may be modified and equivalent elements substituted for those disclosed while continuing to practice the principle of the invention; and it is intended to cover all such modifications and substitutions as they are embraced within the spirit and scope of the appended claims.

I claim:

1. A backpack assembly comprising: a one-piece skeletal plastic frame including an integral peripheral frame portion having an upper frame member, first and second side frame members, and a lower frame member, said frame further including a backplate and a skeletal frame gridwork integrally connecting said backplate with said peripheral frame, said peripheral frame defining a first plurality of elongated slots extending along substantially the entire length of said first and second side frame, said backplate defining a second plurality of elongated slots therein; a backband secured to said frame through said first plurality of slots; a pair of shoulder straps secured at their upper ends to said frame at said second plurality of slots and secured at their lower ends to said frame at said first plurality of slots; fastener means for securing the end portions of said shoulder straps to said frame; and a waistband assembly carried by said frame at said first plurality of slots; whereby said shoulder straps, backband and waistband may be independently adjusted on said frame in accordance with the location of said slots.

2. The apparatus of claim 1 wherein said side frame members of said peripheral frame converge inwardly from an upper location adjacent the head of a bearer carrying said frame to a location approximately at the waist of the bearer and thence diverge outwardly to a lower frame portion at the hip position of the bearer; and wherein said lower peripheral frame member extends outwardly at the rear to avoid restricting motion of the buttocks of the bearer during walking.

3. The apparatus of claim 1 wherein said backplate is spaced rearwardly of said peripheral frame portion to allow head room, and wherein said peripheral frame portion is located outwardly of the head position of the bearer when carried.

4. The apparatus of claim 1 wherein said second plurality of slots on said backplate comprise a first set of slots on one side and a second set of slots on the other side, each set of slots including laterally-spaced, horizontally-elongated slots and vertically-spaced, horizontally-elongated slots whereby the upper end of each shoulder strap may be adjusted laterally and vertically relative to said backplate.

5. The apparatus of claim 1 wherein said first plurality of slots extend substantially throughout the entire periphery of said frame, each slot being in an end-to-end position with adjacent slots.

6. The apparatus of claim 1 wherein said backband comprises a central mesh adapted to engage the back of a bearer and a plurality of tabs extending laterally of each side of said mesh, said tabs each defining a loop and being assembled to said frame by extending through an associated one of said elongated slots on the peripheral portion thereof, said apparatus further comprising means for lacing said loops together to thereby tension said mesh against the peripheral portions of said frame.

7. The apparatus of claim 1 wherein each of said shoulder straps defines a loop at each end for fitting through an associated slot of desired adjustment, and wherein each of said fastener means includes a cylindrical member and a locking member, said cylindrical member fitting through an associated loop and having a diameter greater than the width of an associated slot, said locking member being connected to said cylinder and fitting about a loop when assembled thereto.

8. The apparatus of claim 1 wherein said waistband comprises a flexible belt adapted to fit through said first plurality elongated slots on laterally opposed lower peripheral portions of said frame; and a plurality of pads removably carried by said belt, at least two of said pads being provided with slits, and said belt including a plurality of loops for aligning with said slits, said apparatus further comprising fastener means for securing said loops after extending through an associated slit of one of said pads.

9. A frame for a backpack assembly comprising a molded integral skeletal frame member of rigid plastic foam having an outer peripheral frame portion defining a plurality of elongated slots spaced end-to-end substantially along the peripheral sides thereof for adjustably securing elements to said frame, said peripheral frame portion being contoured about the head of a bearer to allow unrestricted head motion and extending downwardly from the head location and inclined inwardly to a location approximately at the waist of a bearer to permit unrestricted arm motion, and thence diverging outwardly to a location approximately at the waist of the bearer; said peripheral frame portion further including a rearwardly extending bottom frame member defining a plurality of elongated, laterally spaced slots extending end-to-end; and wherein the lower peripheral frame portions of said frame each define a plurality of sets of laterally-spaced slots, each set including a plurality of generally vertically elongated slots extending end-to-end.

10. The apparatus of claim 9 wherein said frame further comprises a backplate defining a first and a second set of generally horizontally extending elongated slots, each set including vertically spaced slots and laterally spaced slots for adjustably securing shoulder straps thereto.

11. In combination, a backpack frame of integral, molded foam plastic providing an interior skeletal frame structure and a peripheral frame structure defining a plurality of elongated slots, said slots being spaced for adjustable attachment of an element to said frame; securing means on said element including a flexible loop extending through one of said slots; and fastener means for securing said loop to said frame said fastener means comprising an integral member having a generallly cylindrical portion for fitting through an associated loop and having a width greater than the width of an associated slot, and an arm hingedly connected to said cylindrical portion for coupling about said loop when said cylindrical member is assembled within said loop.

12. In combination with a backpack frame having at least a pair of elongated slots, one located at either side adjacent the waist position, an adjustable waistband assembly for attaching said backpack frame to a bearer comprising: a flexible belt having a pair of loops; a plurality of padded elements slidably received on said belt, at least two of said elements defining a slit for aligning with the loop of said belt; and fastener means for coupling to said loop of said belt passed through a slit in an associated pad and an associated slot on said frame to thereby secure said pad and said belt to said frame at a predetermined position.

13. The apparatus of claim 12 wherein said plurality of padded elements comprises three padded elements, each removable from and slidably adjustable along said belt, the outermost of said padded elements each including a plurality of laterally spaced slits for aligning with associated loops of said belt whereby said loops will align with the innermost slits of said side padded elements when said third padded element is assembled to said belt and said loops may be aligned with the outermost slits of said side padded elements when said third pad is removed from said belt.

14. The apparatus of claim 13 wherein said fastener means comprises an integral member having an elongated portion adapted to fit through a loop of said belt after passing through an associated slit in said elements and an elongated arm spaced laterally of said elongated member and extending axially thereof and adapted to couple to said loop when said elongated member is passed through said loop.

* * * * *

UNITED STATES PATENT AND TRADEMARK OFFICE

CERTIFICATE OF CORRECTION

PATENT NO. : 3,938,718

DATED : February 17, 1976

INVENTOR(S) : George Benjamin Madison

It is certified that error appears in the above-identified patent and that said Letters Patent are hereby corrected as shown below:

In column 6, line 35, after "frame" insert --members--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*